United States Patent [19]

Kageyama et al.

[11] 4,168,451

[45] Sep. 18, 1979

[54] MULTI-CAVITY KLYSTRON AMPLIFIERS

[75] Inventors: Takao Kageyama; Yosihiro Morizumi, both of Tokyo, Japan

[73] Assignee: Nippon Electric Co., Ltd., Tokyo, Japan

[21] Appl. No.: 920,395

[22] Filed: Jun. 29, 1978

[30] Foreign Application Priority Data

Jul. 1, 1977 [JP] Japan ..... 52-79341

[51] Int. Cl.[2] ..... H01J 25/10

[52] U.S. Cl. ..... 315/5.39; 315/5.51; 315/5.52; 315/5.46

[58] Field of Search ..... 315/5.39, 5.43, 5.51, 315/5.52, 5.53, 5.46; 330/45

[56] References Cited

U.S. PATENT DOCUMENTS

| | | | |
|---|---|---|---|
| 3,028,519 | 4/1962 | Jepsen et al. | 315/5.43 |
| 3,336,496 | 8/1967 | Blinn | 315/39.53 X |
| 3,447,019 | 5/1969 | Romiguiere | 315/5.43 |
| 3,453,483 | 7/1969 | Leidigh | 315/5.51 X |
| 3,483,420 | 12/1969 | Lien et al. | 315/5.39 |
| 3,622,834 | 11/1971 | Lien | 315/5.52 |
| 3,904,917 | 9/1975 | Ueda | 315/5.39 |
| 4,019,089 | 4/1977 | Kageyama et al. | 315/5.39 |

*Primary Examiner*—Saxfield Chatmon, Jr.
*Attorney, Agent, or Firm*—Charles E. Pfund

[57] ABSTRACT

The klystron amplifier comprises an input cavity a plurality of intermediate cavities and an output cavity which are arranged along the path of an electron beam for focusing it, and an output waveguide coupled to the output cavity through a coupling opening. The product $G_0(R/Q)Q_{ex}$ is selected to be $$0.4 \leqq G_0(R/Q)Q_{ex} \leqq 0.7$$

where $G_0$ represents the DC conductance of the electron beam, R/Q the characteristic impedance of the output cavity as defined at the gap between the edges of the drift tubes therein and $Q_{ex}$ the external Q determined by the size of the coupling opening.

2 Claims, 3 Drawing Figures

MULTI-CAVITY KLYSTRON AMPLIFIERS

BACKGROUND OF THE INVENTION

This invention relates to a multi-cavity klystron, more particularly a high power klystron amplifier operating in a millimeter wave band.

Multi-cavity klystrons are widely used in high power sources of a microwave band and a millimeter wave band as ground station output tubes for overhorizon communication and satelite communication. In the field of the satelite communication it is a recent trend to expand the operating frequency from prior art 6 GHz band to a millimeter wave band. Generally speaking, the multi-cavity klystron can operate at a lower direct current beam voltage than a cavity coupled type travelling wave tube having the same output power thereby miniaturizing the transmitter. For this reason, it is expected that the field of application of the multi-cavity klystron would be expanded and such klystron is most suitable for use as the output tube of a movable station for satelite communication.

However, as the operating frequency increases the dimension of the cavity decreases, and in the millimeter wave band the maximum diameter of the cavity decreases below 10 mm and the diameter of a drift tube through which an electron beam passes also decreases below 1 mm. Accordingly, it has been difficult to obtain a high power klystron amplifier having a large gain-bandwidth product suitable for communication for the following reasons.

1. As the electron beam diameter is smaller than 1 mm, the electron beam current density becomes high thereby requiring a large focusing flux density. However, the flux density of the presently available focusing device for electronic tubes is less than 8,000 gauses so that the beam perveance is limited to less than $1\times10^{-6}A/V^{3/2}$.

2. In addition to the fact that the electron beam diameter is reduced and the practical value in beam perveance is limited to a small value, the magnitude of the available DC beam current $I_0$ also tends to decrease with the operating frequency because the cathode diameter of a conventional electron gun is of the order of 10 to 15 times of the electron beam diameter and because the emission current density per unit area of the cathode surface is limited by the useful life of the tube.

3. Since the available DC current beam current $I_0$ is limited, it is necessary to increase the beam voltage $V_0$ for the purpose of obtaining a definite output power. Then, the electron beam DC conductance $G_0$ defined by the following equation decreases.

$$G_0=(I_0/V_0)(v) \quad (1)$$

4. As the resistance loss in the cavity wall due to skin effect increases with the operating frequency, in the millimeter band, the unloaded Q of the cavity decreases to about 1300.

5. Since the dimension of the cavity has been decreased and moreover since the power consumption due to the resistance loss of the cavity wall has been increased as above described the amount of heat generation per unit area increases, whereby the resonance frequency is caused to drift due to the thermal expansion of the cavity, thus varying the output of the tube.

6. When the cavity is constructed to be thermally stable for the purpose of preventing the thermal drift of the resonance frequency described above, the characteristic impedance R/Q which is an important electrical parameter for determining the gain-bandwidth product of the klystron amplifier would decrease below 100 ohms.

In one example of the design of a klystron amplifier operating at a frequency of less than 10 GHz, since there is no such basic difficulties, it is possible to increase the electron beam DC conductance $G_0$ and the characteristic impedance R/Q to the output cavity, it was found that there is the following relationship between these parameters.

$$1\leqq G_0(R/Q)Q_{ex}\leqq 2 \quad (2)$$

Where $Q_{ex}$ represents an external Q determined by the size of coupling means between the output cavity of the klystron and an external circuit.

The relationship of equation 2 is determined by conditions necessary to increase the gain and the band width of the tube, and to make equal the high frequency voltage generated across the interaction gap of the output cavity to the direct current beam voltage at the saturation output, thereby increasing the saturation output power.

One example of the prior art klystron amplifier operating in the millimeter wave band is a klystron amplifier having a band center frequency of 35 GHz and described in B. G. James and L. T. Zitelli paper of the title "Kilowatt CW Klystron Amplifiers at $K_u$ and $K_a$ Bands," The Microwave Journal, 1968, November page 53. In this klystron amplifier, the parameters are selected such that: the DC beam voltage $V_0=10{,}750$ V, the DC beam current $I_0=1.0$ A, the unloaded Q of the output cavity $=1400$, the characteristic impedance of the output cavity $R/Q=50$, and the external Q of the output cavity $Q_{ex}=350$. More particularly, the design parameters of this klystron amplifier have been selected such that the decreases in the electron beam DC conductance $G_0$ and in the characteristic impedance R/Q of the output cavity are compensated for by selecting a large value 350 for the external $Q_{ex}$ of the output cavity and that the product $G_0(R/Q)\cdot Q_{ex}$ will be 1.63 which is in the range defined by equation 2.

However, in a klystron amplifier operating in the millimeter wave band, if the value of $Q_{ex}$ were increased so as to satisfy the relationship of equation 2, although the peak value of the output power would increase to some extent, the gain-bandwidth product would decrease. This is caused by the decrease in the conductance $Q_0$ of the output cavity and since the circuit efficiency $\eta_c$ defined by the following equation decreases with the increase in the external $Q_{ex}$, thus making it difficult to increase the output power as expected.

$$\eta_c=Q_0/Q_{ex}+Q_0) \quad (3)$$

Decrease in the circuit efficiency not only limits the power output but also increases the heat generation cuased by the resistance loss in the output cavity thereby causing unstable the operation of the klystron amplifier which is a fatal defect for a practical tube.

SUMMARY OF THE INVENTION

Accordingly, it is an object of this invention to provide an improved high power multi-cavity klystron amplifier which can operate stably in a millimeter wave band and has a large-gain bandwidth product.

According to this invention, there is provided a multi-cavity klystron amplifier of the class comprising an electron gun for emitting an electron beam, an input cavity, a plurality of intermediate cavities and an output cavity, the cavities being sequentially disposed along a path of the electron beam in the order mentioned, drift tubes respectively disposed between adjacent cavities, and a collector electrode disposed at the end of the electron beam path, the cavities and the drift tubes being coaxially disposed, and the amplifier having a pass band having a predetermined frequency width, characterized in that the dimension of the output cavity is selected to satisfy the following relationship $$0.4 \leqq G_0(K/Q)Q_{ex} \leqq 0.7 \quad (4)$$

where $G_0$ represents direct current conductance of the electron beam, R/Q characteristic impedance of the output cavity which is defined at the gap between the edges of the drift tube, and $Q_{ex}$ an external Q determined by the size of output coupling means between the output cavity and an output waveguide coupled thereto.

The reason for selecting the product $G_0(R/Q)Q_{ex}$ between 0.4 and 0.7 is as follows.

More particularly, when the diameter of the coupling opening between the output cavity and the output waveguide is increased for the purpose of decreasing $Q_{ex}$, the amount of electric energy transmitted to the output cavity from the electron beam decreases but the output power would not decrease too much unless the value of $Q_{ex}$ is reduced extremely. Because, the value of $Q_0$ is small and the percentage of improvement of the circuit efficiency $\eta_c$ when $Q_{ex}$ is decreased is large. Moreover, when $Q_{ex}$ is decreased the bandwidth is increased, and the product of the gain and bandwidth shows the maximum value in the range specified by equation 4. Further the stability of the operation is improved.

DESCRIPTION OF THE PREFERRED EMBODIMENT

Figure 1:
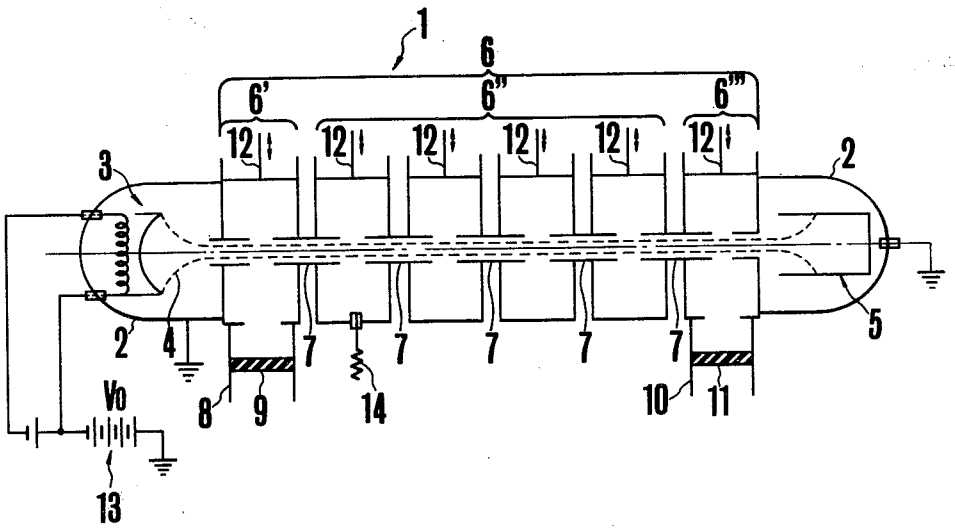
FIG. 1 is diagrammatic longitudinal sectional view showing the construction of a 6 cavity klystron amplifier embodying the invention.

A preferred embodiment of a high power multi-cavity klystron amplifier 1 embodying the invention and shown in FIG. 1 comprises an evacuated envelope 2, an electron gun assembly 3 contained in one end of the envelope 2 for emitting an electron beam 4 and a collector electrode 5 at the other end of the envelope 2, that is at the terminal end of a long beam path. A high frequency circuit 6 is contained in the envelope 2 for amplifying a signal wave by subjecting the electron beam 4 to a cumulative electromagnetic interaction. The high frequency circuit 6 comprises 6 cavities which are sequentially arranged coaxially along the beam path. Adjacent cavities are interconnected by drift tubes 7 and the cavities are classified into an input cavity 6', intermediate cavities 6'' and an output cavity 6''' starting from the upstream side. A signal wave to be amplified is applied to the input cavity 6' on the upstream side of the high frequency circuit 6 through a transmissive air tight window 9 sealed to an input waveguide 8 disposed adjacent the electron gun assembly 3. The amplified signal wave is derived out from the output cavity 6'' through a transmissive an tight window 11 via an output waveguide 10 which is disposed adjacent the collector electrode 5.

Usually, the evacuated envelope 2, the high frequency circuit 6 and the collector electrode 5 are maintained at the ground potential and a source 13 is connected to the cathode filament of the electron gun assembly 3 so as to supply a direct current beam voltage $V_0$ and a direct current beam current $I_0$ to the tube 1.

For the purpose of improving the band characteristic of the tube each cavity is provided with a well known tuning means 12 that varies the resonance frequency of the cavity, and at least one of the intermediate cavities 6'' is connected with an external load resistor 14.

In operation, the signal wave to be amplified is applied to the tube 1 through input waveguide 8. The input signal wave effects a velocity modulation of the electron beam 4 in the input cavity 6' and while the velocity modulated electron beam 4 passes through the drift tube 7 and the intermediate cavities 6'' the beam is focused to have a high density. The kinetic energy of the electron beam 4 thus changed to density modulation from velocity modulation is converted into an electric energy in the output cavity 6''' and then derived out through the output waveguide 10 as an amplified signal wave.

Figure 2:
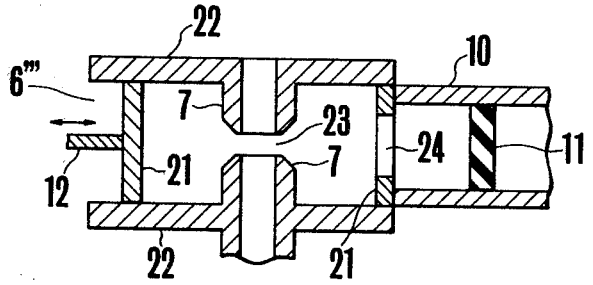
FIG. 2 is a sectional view showing the output cavity and the output waveguide of the klystron tube shown in FIG. 1.

The detail of the construction and operation of the output cavity 6''' will now be described with reference to FIG. 2. Thus, the output cavity 6''' comprises an electroconductive cylinder 21 concentric with the tube axis, and electroconductive end plates 22 at the opposite ends of the cylinder 21. The ends plates 22 are provided with axial openings extending in the direction of the electron beam path for the purpose of passing the electron beam 4 through the output cavities 6'''. Drift tubes 7 made of copper or the like are connected to the inner surfaces of the end plates to extend in the direction of the electron beam path so as to define an interaction gap or space 23 between the opposing ends of the drift tubes 7. A portion of the wall of the electroconductive cylinder 21 is constructed to be movable with the tuning means 12, and a coupling opening 24 for the output waveguide 10 is provided through the wall of the cylinder 21 to oppose the tuning means 12.

The electron beam 3 which has been focused or concentrated while it passes through the input cavity 6', the intermediate cavities 6'' and the drift tubes 7 induces a high frequency current in the wall of the output cavity 6''' thus generating a high frequency voltage across the interaction gap 23. This high frequency voltage functions to decelerate the focused electron beam thereby converting its kinetic energy into an electric energy. A portion of the electric energy stored in the output cavity 6''' is consumed as a heat energy by the resistance loss in the inner walls of the output cavity, while the remaining portion is sent out to the output waveguide 10 via the coupling opening 24. Thus, the power of the output signal wave derived out through the output waveguide 10 is the difference between the electric energy stored in the output cavity 6''' and the heat energy caused by the resistance loss.

When the external $Q_{ex}$ is increased by decreasing the diameter of the coupling opening 24, the electric energy stored in the output cavity 6''' can be increased, while the resistance loss increases and the band width of the tube is decreased. Therefore, there is a limit or optimum value for the size of the coupling opening 24, that is the external $Q(Q_{ex})$.

Figure 3:
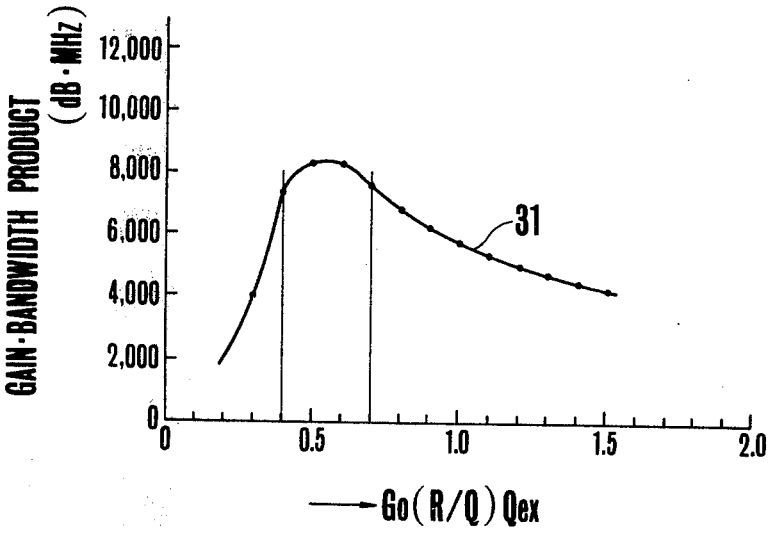
FIG. 3 is a graph showing the relationship between the product $G_0(R/Q)Q_{ex}$, and the gain·bandwidth product of the tube shown in FIG. 1.

FIG. 3 is a graph showing the relationship between the product of the electron beam DC conductance $G_0$, the impedance R/Q of the output cavity, and the external $Q_{ex}$, that is $G_0(R/Q)Q_{ex}$, and the product of the gain and the bandwidth, that is dB·MHz. As shown by curve 31, the product $G_0(R/Q)Q_{ex}$ shows a maximum in a range of from 0.5 to 0.6, and the peak value of the gain-bandwidth product at this time is 8400 dB·MHz. This corresponds to the maximum value created by the fact that the conversion efficiency and the circuit efficiency of the output cavity vary in the opposite directions. The position of this maximum value shifts to a point where the product $G_0(R/Q)Q_{ex}$ is larger than unity when the operating frequency decreases below 10 GHz. Conversely, as the operating frequency increases, the maximum point of the gain·bandwidth product shifts to a point where the product $G_0(R/Q)Q_{ex}$ is small. However, when the product $G_0(R/Q)Q_{ex}$ is too small, the output would become small thus rapidly decreasing the power gain and the limit of the product $G_0(R/Q)Q_{ex}$ is 0.4. As shown in FIG. 4, when $G_0(R/Q)Q_{ex}=0.4$, the product of the bandwidth and the gain is 7500 dB·MHz which is smaller than the peak value by 0.5 dB. When the product $G_0(R/Q)Q_{ex}$ becomes larger than 0.7, the electric energy stored in the output cavity 6''' comes larger. This phenomenon induces the reduction in the bandwidth of tube. In addition, thermal and electrical instability results with an increase of the product $G_0(R/Q)Q_{ex}$.

Design parameters utilized in the embodiment shown in FIG. 1 are as follows:

| | |
|---|---|
| band cement frequency $f_0$ | 30.0 GHz |
| DC beam voltage $V_0$ | 10,000 V |
| DC beam current $I_0$ | 0.4 A |
| characteristic impedance R/Q of the putput cavity | 75 ohms |
| external Q of the output cavity ($Q_{ex}$) | 180 |
| unloaded Q of the output cavity ($Q_0$) | 1,300 |

In this embodiment, the size of the coupling opening 24 is selected such that the product $G_0(R/Q)Q_{ex}$ will be 0.54. With this design, at the output power level 300 W can be obtained, and at −1 dB a bandwidth of 200 MHz can be obtained. When compared with the prior art design, the gain·bandwidth product has improved 1.6–2 times.

What is claimed is:

1. In a multi-cavity klystron amplifier of the class comprising an electron gun for emitting an electron beam, an input cavity, a plurality of intermediate cavities, and a output cavity, said cavities being sequentially disposed along a path of said electron beam in the order mentioned, drift tubes respectively disposed between adjacent cavities, and a collector electrode disposed at the end of said electron beam path, said cavities and said drift tubes being coaxially disposed and said amplifier having a pass band having a predetermined frequency width, the improvement wherein the dimension of said output cavity is selected to satisfy the following relationship $$0.4 \leqq G_0(R/Q)Q_{ex} \leqq 0.7$$

where $G_0$ represents direct current conductance of said electron beam, R/Q characteristic impedance of said output cavity which is defined at the edge gap thereof, and $Q_{ex}$ an external Q determined by the size of output coupling means between said output cavity and an output waveguide coupled thereto.

2. A multi-cavity klystron amplifier according to claim 1 wherein said output cavity comprises an electroconductive cylinder, electroconductive end plates connected to the opposite ends of said cylinder and provided with axial openings for passing said electron beam, drift tubes secured to the inner sides of said end plates, tuning means electrically connected to one side wall of said cylinder, and wherein said interaction gap is defined between the opposing inner ends of said drift tubes, and said coupling means comprises an opening provided through the other side wall of said cylinder.

* * * * *